United States Patent [19]

Hinosugi et al.

[11] 4,339,475

[45] Jul. 13, 1982

[54] METHOD OF FORMING A FLUORESCENT SCREEN FOR CATHODE-RAY TUBE

[75] Inventors: Misturu Hinosugi; Kouichi Nakasato, both of Mobara, Japan

[73] Assignee: Hitachi, Ltd., Tokyo, Japan

[21] Appl. No.: 132,398

[22] Filed: Mar. 20, 1980

[30] Foreign Application Priority Data

Mar. 23, 1979 [JP] Japan ..... 54-33302
Mar. 23, 1979 [JP] Japan ..... 54-33303

[51] Int. Cl.[3] ..... B05D 3/02; B05D 1/38

[52] U.S. Cl. ..... 427/64; 427/55; 427/68

[58] Field of Search ..... 427/55, 64, 68

[56] References Cited

U.S. PATENT DOCUMENTS 3,067,055 12/1962 Saulnier ..... 427/68 X
3,317,337 5/1967 Saulnier ..... 427/68 X
3,574,663 4/1971 Schniepp ..... 427/68
3,579,367 5/1971 Patel ..... 427/68 X
3,582,389 6/1971 Saulnier ..... 427/68
3,582,390 6/1971 Saulnier ..... 427/68 X

*Primary Examiner*—James R. Hoffman
*Attorney, Agent, or Firm*—Charles E. Pfund

[57] ABSTRACT

A method of forming a fluorescent screen for a cathode ray tube comprises forming a phosphor layer on the inner surface of a panel, coating the panel inner surface and the phosphor layer with an aqueous emulsion of water insoluble filming resin in order to form a base layer which is evaporative, forming a metal film upon the base layer and evaporating organic substances of the base layer coated upon the panel inner surface. The phosphor layer, while it is still wet, is coated with the aqueous emulsion of water insoluble filming resin of which pyrolysis temperature is not greater than 420° C. to form the substrate layer.

14 Claims, 3 Drawing Figures

METHOD OF FORMING A FLUORESCENT SCREEN FOR CATHODE-RAY TUBE

BACKGROUND OF THE INVENTION

This invention relates to a method of forming a fluorescent screen for a cathode-ray tube, for instance, a color picture tube, and more particularly to a method of forming a fluorescent screen for a cathode-ray tube by coating a phosphor layer with an aqueous emulsion containing a water insoluble film forming resin, drying the film to form a base layer, depositing a metal film on the base layer and subjecting the base layer to pyrolysis to gasify and eliminate the same, in other words, evaporating the base layer.

The method of forming a metal coating on a fluorescent screen for a cathode-ray tube has been disclosed, for instance, in U.S. Pat. No. 3,067,055. Further, Japanese Patent Publications No. 24416/72 and No. 48263/72 propose a method wherein a water soluble film forming polymer is mixed with the aqueous emulsion which is a mixture of a water insoluble film forming resin and water and further, various additional substances are mixed with the resulting mixture in order to flatten the metal film and to reduce the blisters produced at the time of heating. The method comprises the steps of coating a phosphor layer with an aqueous emulsion of acrylate resin co-polymer, forming an evaporative base layer by heat-drying the film, depositing a metal film on the surface of the base layer and evaporating the base layer. The combination of the steps used for forming the base layer is termed "filming", the emulsion used for the purpose is termed "filming emulsion", and the step to evaporate the base layer is termed "heat-evaporation". The above method is characterized in that an emulsion of a mixture of complex boric acid of polyvinyl alcohol, hydrogen peroxide, potassium silicate and colloidal silica is added to the filming emulsion in order to prevent blisters on the metal film caused by the heat evaporation.

As the filming emulsion to be coated on the phosphor layer which has been formed on the inner surface of a cathode-ray tube bulb panel in the above conventional method, an aqueous emulsion has been used which is prepared by mixing a co-polymer of acrylic resin of a high pyrolysis temperature in the range of 400° to 480° C., complex boric acid of polyvinyl alcohol and water. The heat-evaporation step is generally carried out at the temperature in the range of 400° to 450° C. The prior art method has such drawbacks that when the evaporation step is carried out by frit-baking alone, omitting panel-baking, in order to shorten the time required for the heat evaporation, although organic substance such as the filming emulsion is partially gasified in the pyrolysis, some of the organic substance, not fully decomposed, is still left on the inner face of the panel. Also the gasified substance is adhered to the surface of a shadow mask mounted inside the tube of a completed bulb, deteriorating the shadow mask chemically. It has another drawback that the resin which is not decomposed remains on the fluorescent screen, lowering the luminescence characteristics of the cathode-ray tube, and reducing luminosity. When an aqueous emulsion of water insoluble resin is used in the filming step in the conventional method, the resin penetrates into the phosphor film to prevent the formation of a uniformly flat film and deteriorate the luminosity of the completed tube.

The uniformly flat film might be formed by coating the filming emulsion twice, but this makes the resinous film too thick to prevent blisters which might be caused on the metal film by gasified substance produced in the subsequent step, i.e. the heat-evaporation step, thereby causing such drawbacks as deteriorated luminosity or the defective film of the completed tube.

SUMMARY OF THE INVENTION

Accordingly, an object of the present invention is to eliminate the aforementioned drawbacks and to provide a method of forming a fluorescent screen for a cathode-ray tube wherein an excellent base layer can be formed with the use of filming emulsion containing a minimized amount of water-insoluble resin.

In order to attain the above object, this invention is featured by coating a phosphor layer, when still wet, with an aqueous emulsion of water insoluble film forming resin which has a minimum film forming temperature of 10° to 45° C., remarkably lower than the conventionally used temperatures, and excellent pyrolysis characteristics (below 420°).

In the present method, since the filming emulsion is coated on the phosphor layer when the layer is still wet with gaps between phosphor powders filled with water, the resin contained in the emulsion can not easily permeate into the gaps; therefore, an emulsion containing relatively small amount of resins suffices the formation of a base layer of the resin film on the phosphor film, which base layer is thin but satisfactory for filming. And, since a film of the filming emulsion according to the present invention is formed at a low temperature, the heat evaporation step can be simplified to produce a metal film which is uniformly flat without blisters and with excellent reflection factor.

DESCRIPTION OF PREFERRED EMBODIMENTS

Figure 1:
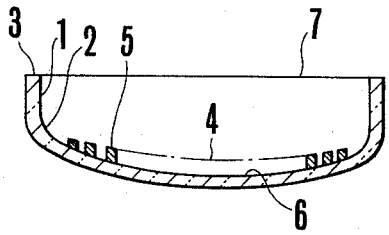
FIG. 1 is a sectional view schematically showing a phosphor layer deposited on the inner face of a panel of a cathode ray tube bulb to which this invention is applicable.

The present invention is applicable to a cathode-ray tube such as a color picture tube and the bulb thereof is shown in FIG. 1 wherein the bulb is provided with a panel 7 having a skirt 1, a corner 2, a seal face 3 and an effective area or a picture area 4, the inner surface of the panel being deposited with a phosphor layer 5 comprising phosphor picture elements, a funnel (not shown) joined to the seal face 3 of the panel 7 and a neck (not shown) joined to the funnel. A color selecting electrode such as a shadow mask (not shown) is arranged at a position with a predetermined distance from the inner face 6 of the panel 7 and an electron gun (not shown) is provided inside the neck. In the structure mentioned above, an electron beam emitted from the electron gun impinge on the phosphor layer 5 covered with a metal film which is formed through the filming step (which will be described later) in order to display a predetermined color picture image.

Figure 2:
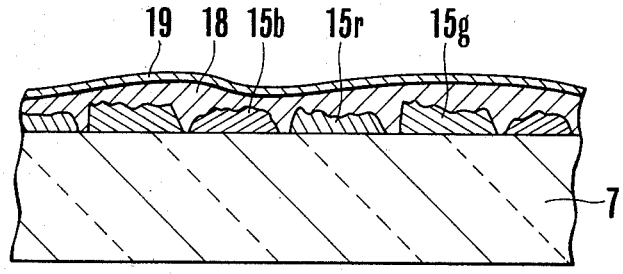
FIG. 2 is an enlarged sectional view showing an example of the steps to form a fluorescent screen.

The fluorescent screen of the present invention is formed in the following steps. Here, the method is particularly described for the case of a fluorescent screen in the form of stripes but may obviously be applicable to a dot type fluorescent screen. As shown in FIG. 2, phosphor stripes 15*r*, 15*g* and 15*b* are formed on the inner face of the panel by a well known method. In this case, a stripe pattern (not shown) forming a black matrix film may or may not be formed. On the phosphor stripes 15*r*, 15*g* and 15*b*, when they are still wet, a filming solution prepared by mixing water insoluble film forming resin (for instance, a polymer of acrylate such as alkyl acrylate or alkyl methacrylate; a polymer of acrylic acid or methacrylic acid; a combination of these substances which is acrylic resin co-polymer; a polymer of vinyl acetate, styrene acrylate or acrylic nitrile; or a copolymer of these substances; the above substances being used either alone or in combination considering their hardness, elasticity, and pyrolysis characteristics) water and, if necessary, an additional assistant for film formation such as ethylcarbitol acetate, butyl cellosolve acetate, trimethylpentanediol or trimethylpentanediol-monoisobutylate, is coated and, then, dried to form a base layer 18.

This filming emulsion has such characteristics that the minimum film forming temperature is 10° to 45° C. and that the pyrolysis temperature is not greater than 420° C. Besides the above composition, if a bond assistant, for example, silicate such as potassium silicate is added to the filming emulsion in an amount less than 4 wt. %, the bond between the phosphor layer and the metal film (usually an aluminum film) is strengthened and the adhesiveness of the metal film is improved. Further, if a crystal separating substance such as ammonium oxalate is added in an amount less than 4 wt. %, a large number of pinholes are formed in the metal film during aluminum coating, which pinhole acts as outlets for the gas in the heat-evaporation step to prevent blisters on the metal film. After forming the base layer 18, a metal film 19 is formed according to a prior art method. Then, a baking step, either independently or simultaneously with other steps, is carried out to evaporate the base layer 18 to obtain a fluorescent screen.

The invention will now be described with reference to examples.

After forming a phosphor layer, the inside of the panel including the phosphor layer is rinsed with either cold or warm water and is warmed with warm water, heater or infra red ray so as to make the temperature in the phosphor layer more than 35° C. Then, a filming emulsion of the composition below is coated.

| Material | Concentration of Solid |
|---|---|
| Water insoluble resin film forming emulsion | 10–30% |
| Assistant for film formation | 0.5–5% |
| Water | Remainder |

When the film forming temperature of the water insoluble emulsion exceeds 45° C., the emulsion will penetrate into the phosphor film and uniformly flat resin film cannot be obtained. On the other hand, if it is less than 10° C., the mass productivity is reduced. Therefore, the concentration of the assistant for film formation must be adjusted in order to keep the minimum film forming temperature lower than the phosphor film temperature at the time of coating. The emulsion is coated uniformly on the phosphor film and dried by a heater, infra red ray or heated air to form a film.

Through the steps described above, a thin uniformly flat film was formed on the phosphor film which, consequently, improved the brightness of the tube without causing defects on the film. When the film formation assistant was added to the water insoluble film forming resin, the minimum film forming temperature (referred to as MFT hereinafter) is reduced remarkably, contributing to the film forming temperature adjustment.

The following are examples of the filming emulsion.

EXAMPLE 1

| Material | Concentration of Solid (%) |
|---|---|
| Water insoluble resin: | |
| Primal C-72 (manufactured by Nippon Acryl) | 11 |
| N-butyl methacrylate | 9 |
| Film formation assistant: | |
| 2,2,4-trimethyl-1,3-pentanediol monoisobutylate | 2.0 |
| Water | Remainder |

EXAMPLE 2

| 'Material | Concentration of Solid (%) |
|---|---|
| Water insoluble resin: | |
| Primal B-74 (manufactured by Nippon Acryl) | 2.0 |
| Film formation assistant: | |
| Butylcellosolve acetate | 4.0 |
| Water | Remainder |

It was proved that, with the use of filming emulsions shown in the above examples, metal films with excellent reflection factor and without blisters on the effective area of the fluorescent screen were obtained. Besides the film formation assistant described, the bond assistant which increases the bond between the aluminum coating and the phosphor or a crystal separating substance which promotes the formation of pinholes in the aluminum coating, or the both may be added to the water insoluble resin of the filming emulsion. In the above examples, the base layer can be formed without using a resin of inferior pyrolysis characteristics, for instance, a resin which does not decompose at a temperature less than 450° C. Therefore, resins of excellent pyrolysis characteristics alone, for instance, methyl methacrylate in the case of acrylic resin, can be used in this invention, thus eliminating a furnace for the heat-evaporation step. On the other hand in conventional method, after the base layer is passed through the heat-evaporation step, a furnace had to be used to weld a funnel and to form a bulb. Thus, this invention is excellent in steps and in characteristics, producing excellent metal films.

In typical coating step using the filming emulsion, the emulsion is coated not only on the effective area but on other areas of the fluorescent screen. More particularly, the skirt or the seal of the panel is coated with the filming emulsion and becomes dried before the effective area does so to form a film from which the gas produced in pyrolysis less readily escapes than from the effective area. Accordingly, after the formation of the metal film and in the step of evaporating organic substances, blisters are formed in the areas other than the effective area after the formation of the metal film.

According to the present invention, therefore, there is added another step, preferably after the last step in the above examples, to replace the emulsion which has been coated in the areas other than the effective area such as the skirt or the corner (referred to as a first emulsion hereinafter) with another emulsion (referred to as a second emulsion hereinafter) while it is still wet, by spraying, for example, the second emulsion onto the first emulsion on the other areas than the effective area. The film forming temperature of the second emulsion is higher than that of the first emulsion.

Figure 3:
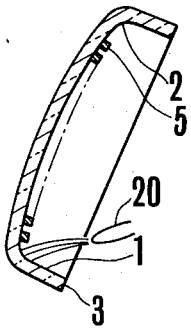
FIG. 3 is a sectional view to explain a modified embodiment of the present invention.

FIG. 3 shows such an embodiment of this invention. As shown in the figure, before drying step, the first emulsion coated from the corner 2 to the panel skirt 1 is sprayed, with the second emulsion of a water soluble film forming polymer such as 1–3 wt. % solution of complex boric acid of polyvinyl alcohol, or of aqueous emulsion of water insoluble resin such as containing by 5–30 wt. % co-polymer of ethyl methacrylate or acrylic acid which has a minimum film forming temperature lower than that of the first emulsion in order to perforate the film over the skirt and corner portions. This will make the gasified substance escape to eliminate blisters. Further, in order to improve the adhesiveness between the panel glass and the metal film in a manner similar to the previous embodiment, colloidal silica in an amount, for instance, of 0.1–40 wt. % may be added to the second emulsion. Moreover, in order to prevent blisters from forming in the metal film over the skirt and corner portions, 0.1–4 wt. % of needle-shaped crystal separating substance such as ammonium oxalate, boric acid or borax or of the bond assistant may be added in a manner similar to the previous embodiment. In the figure, reference numeral 20 denotes a nozzle to spray the second emulsion and the panel is kept inclined by the angle shown in FIG. 3 when it is sprayed.

Examples of the first and second emulsions are shown below:

EXAMPLE 1

| Material | Concentration of Solid (%) |
|---|---|
| The first emulsion | |
| Primal C-72 or B-74 (manufactured by Nippon Acryl) | 11 |
| N-butyl methacrylate | 9 |
| 2,2,4-trimethyl-1,3-pentanedial-monoisobutylate | 2.0 |
| Water | Remainder |
| The second emulsion | |
| Primal B-85 ;(manufactured by Nippon Acryl; (also available under Rhoplex trademark from Rohm & Haas) (or methyl emulsion, mi-butyl methacrylate emulsion) | 6.0 |
| Water | Remainder |

EXAMPLE 2

| | |
|---|---|
| The first emulsion | |
| Primal B-74 | 2.0 |
| butyl cellosolve acetate | 4.0 |
| Water | Remainder |
| The second emulsion | |
| ammonium | 2.0 |
| Water | Remainder |

In the experiments with the use of the emulsions of composition described above, it was proved to produce fluorescent screens without blisters on both the effective area and the skirt and with excellent reflection factor of the metal film.

What is claimed is:

1. A method of forming a fluorescent screen for a cathode ray tube comprising the steps of forming a phosphor layer on the inner surface of a panel, coating the panel inner surface and said phosphor layer with an aqueous emulsion of water insoluble film forming resin in order to form a base layer, forming a metal film upon said base layer, and eliminating organic substances of the base layer coated on the panel inner face by pyrolysis, wherein the pyrolysis temperature of said film-forming resin is not greater than 420° C. and said emulsion is coated while the phosphor layer is still wet to form said base layer.

2. A method of forming a fluorescent screen as claimed in claim 1 wherein said aqueous emulsion further includes a plasticizer.

3. A method of forming a fluorescent screen as claimed in claim 2 wherein said film-forming resin has a minimum film forming temperature of 10° to 45° C.

4. A method of forming a fluorescent screen as claimed in claim 2 wherein said aqueous emulsion further includes a bond assisting agent for strengthening the bond between the phosphor layer and the metal film and improving the adhesiveness of the metal film.

5. A method of forming a fluorescent screen as claimed in claim 2 wherein said aqueous emulsion further includes a compound selected from ammonium oxalate, boric acid, or borax.

6. A method of forming a fluorescent screen as claimed in claim 2 wherein said aqueous emulsion further includes in combination a bond assisting agent for strengthening the bond between the phosphor layer and the metal film and improving the adhesiveness of the metal film and a compound selected from ammonium oxalate, boric acid, or borax.

7. A method of forming a fluorescent screen as claimed in claim 1 further comprising, next to the step of coating with said aqueous emulsion, replacing said aqueous emulsion coated on areas other than the effective area of the panel inner surface with a second aqueous emulsion of water insoluble filming resin of which film forming temperature is higher than that of said film-forming resin.

8. A method of forming a fluorescent screen as claimed in claim 7 wherein the second aqueous emulsion further includes a bond assisting agent for strengthening the bond between the phosphor layer and the metal film and improving the adhesiveness of the metal film.

9. A method of forming a fluorescent screen as claimed in claim 7 wherein the second aqueous emulsion further includes colloidal silica.

10. A method of forming a fluorescent screen as claimed in claim 7 wherein the second aqueous emulsion further includes a compound selected from ammonium oxalate, boric acid, or borax.

11. A method of forming a fluorescent screen as claimed in claim 7 wherein the second aqueous emulsion further includes in combination a bond assisting agent for strengthening the bond between the phosphor layer and the metal film and improving the adhesiveness of the metal film and a compound selected from ammonium oxalate, boric acid, or borax.

12. A method of forming a fluorescent screen as claimed in claim 7 wherein the second aqueous emulsion further includes in combination colloidal silica and a compound selected from ammonium oxalate, borac acid, or borax.

13. A method of forming a fluorescent screen as claimed in claim 7 wherein the second aqueous emulsion further includes in combination colloidal silica and a bond assisting agent for strengthening the bond between the phosphor layer and the metal film and improving the adhesiveness of the metal film.

14. A method of forming a fluorescent screen as claimed in claim 7 wherein the second aqueous emulsion further includes in combination a bond assisting agent for strengthening the bond between the phosphor layer and the metal film and improving the adhesiveness of the metal film, a compound selected from ammonium oxalate, boric acid, or borax and colloidal silica.

* * * * *

UNITED STATES PATENT AND TRADEMARK OFFICE

CERTIFICATE OF CORRECTION

PATENT NO. : 4,339,475

DATED : July 13, 1982

INVENTOR(S) : Misturu Hinosugi and Kouichi Nakasato

It is certified that error appears in the above—identified patent and that said Letters Patent is hereby corrected as shown below:

Column 5, line 51, after "(or methyl" insert -- methacrylate --.

line 52, change "mi-butyl" to -- i-butyl --.

line 63, after "ammonium" add -- oxalate --.

Signed and Sealed this

*Fourteenth* Day of *September 1982*

[SEAL]

*Attest:*

GERALD J. MOSSINGHOFF

*Attesting Officer* *Commissioner of Patents and Trademarks*